US008680409B2

(12) United States Patent
Birner et al.

(10) Patent No.: US 8,680,409 B2
(45) Date of Patent: Mar. 25, 2014

(54) ELECTRIC SWITCH

(75) Inventors: Jürgen Birner, Amberg (DE); Walter Felden, Rieden (DE); Bernhard Hannich, Hahnbach (DE); Johannes Hauer, Poppenricht (DE); Andreas Hierl, Schmidgaden (DE); Siegfried Pirker, Ensdorf (DE); Thomas Pniok, Hamburg (DE); Ralf Schwager, Kümmersbruck (DE)

(73) Assignee: Siemens Aktiengesellschaft, Munich (DE)

( * ) Notice: Subject to any disclaimer, the term of this patent is extended or adjusted under 35 U.S.C. 154(b) by 95 days.

(21) Appl. No.: 13/356,790

(22) Filed: Jan. 24, 2012

(65) Prior Publication Data

US 2012/0186955 A1 Jul. 26, 2012

(30) Foreign Application Priority Data

Jan. 25, 2011 (DE) ..... 10 2011 003 131

(51) Int. Cl.
*H01H 19/00* (2006.01)

(52) U.S. Cl.
USPC ..... 200/11 R; 200/400

(58) Field of Classification Search
USPC ..... 200/400, 318, 325, 327, 401, 244
See application file for complete search history.

(56) References Cited

U.S. PATENT DOCUMENTS

| | | | | |
|---|---|---|---|---|
| 6,437,269 | B1 * | 8/2002 | Rakus | 200/400 |
| 6,563,407 | B2 * | 5/2003 | Kramer | 335/16 |
| 6,590,173 | B2 * | 7/2003 | Uchida et al. | 200/244 |
| 8,071,898 | B2 * | 12/2011 | Bennett et al. | 200/244 |
| 2009/0057112 | A1 | 3/2009 | Bennett et al. | |

FOREIGN PATENT DOCUMENTS

| | | | |
|---|---|---|---|
| DE | 10056816 | A1 | 5/2002 |
| DE | 10056820 | A1 | 5/2002 |
| DE | 10252741 | B3 | 2/2004 |
| DE | 102007040163 | A1 | 2/2009 |
| DE | 102008037967 | A1 | 2/2010 |
| DE | 102008039066 | A1 | 2/2010 |
| DE | 102008039066 | A1 | 2/2010 |
| EP | 0314540 | B1 | 5/1989 |
| WO | WO0241346 | A1 | 5/2002 |
| WO | WO0241439 | A1 | 5/2002 |

OTHER PUBLICATIONS

German Priority document for German Application No. DE 10 2011 003 131.6 (Not Yet Published).

* cited by examiner

*Primary Examiner* — Kyung Lee

(74) *Attorney, Agent, or Firm* — Harness, Dickey & Pierce, P.L.C.

(57) ABSTRACT

An electric switch is disclosed. In at least one embodiment, the switch includes a rotor housing; at least one electric contact arm, rotatably mounted in the rotor housing and being pivotable between an on-position and an off-position as well as relative to the rotor housing; and at least one intermediate part which, in a locking position, locks the pivotable contact arm with the rotor housing and, in the event of a relative rotation between the pivotable contact arm and the rotor housing, is moved away from the predefined locking position.

11 Claims, 8 Drawing Sheets

ELECTRIC SWITCH

PRIORITY STATEMENT

The present application hereby claims priority under 35 U.S.C. §119 to German patent application number DE 10 2011 003 131.6 filed Jan. 25, 2011, the entire contents of which are hereby incorporated herein by reference.

FIELD

At least one embodiment of the invention generally relates to an electric switch, in particular an electric circuit-breaker.

BACKGROUND

Such a switch is known from the German patent publication DE 10 2008 039 066 A1. This switch comprises a rotor housing and an electric contact arm, rotatably mounted in the rotor housing, the contact arm being pivotable between an on-position and an off-position as well as relative to the rotor housing. In the on-position, the electric contact arm connects a contact element of the contact arm to a stationary contact element of the switch. In the off-position, the contact element of the contact arm and the stationary contact element of the switch are separated. For switching on and off, the contact arm can be pivoted by rotating the rotor housing; the rotating rotor housing carries the contact arm with it and also pivots the contact arm. In addition, the contact arm can pivot even without a rotation of the rotor housing, i.e. relative to the rotor housing, namely if the current flowing via the contact arm becomes too great: in this case, the contact arm is pivoted relative to the rotor by way of a magnetic force induced by the current, the contact element of the contact arm and the stationary contact element of the switch being separated from one another as a result.

In one of the embodiments described in the German patent publication DE 10 2008 039 066 A1, two intermediate parts are present which, in a predefined locking position, lock the pivotable contact arm with the rotor housing and, in the event of a relative rotation between the pivotable contact arm and the rotor housing, are moved away from the predefined locking position. Each of the two intermediate parts consists of a pressure element which is pivotably connected at one end to a pivot bearing of the contact arm and at another end holds a roller via a rotation bearing. The roller can roll on a wall section of the switch.

SUMMARY

In at least one embodiment of the invention, a switch is specified which has few parts and a particularly easy-to-assemble design.

Advantageous embodiments of the switch are specified in subclaims.

It is provided according to at least one embodiment of the invention that the intermediate part is a spherical body which, in the predefined locking position is held in a resiliently clamped manner. Spherical bodies are understood here to mean bodies whose surface is spherical or spheroidal.

A substantial advantage of the switch according to at least one embodiment of the invention is its simple mechanical design and the resulting ease of assembly. In contrast to the switch described in the introduction, in which each intermediate part comprises one pressure element, one roller and two rotation bearings, the intermediate part in the switch according to the invention is formed by a spherical body which can be held only by way of clamping—i.e. with no mechanical connection to other parts. For assembly, the spherical body can merely be inserted between the pivotable contact arm and the rotor housing and clamped there. Fewer parts are thus required for the locking mechanism between the pivotable contact arm and the rotor housing, which reduces the manufacturing and assembly costs significantly.

A further substantial advantage of the switch according to at least one embodiment of the invention is that, due to the spherical shape of the intermediate part, it is possible to rotate the contact arm with very little friction and thus also with very small trip forces and/or very small trip currents. This makes it possible to achieve current limitation even when there are "no" short-circuit currents and at the same time to reduce burning of the contacts, as the contacts can be opened with no appreciable delay.

The intermediate part is preferably a hollow body with a spherical or ellipsoidal surface or a solid spherical body or a solid ellipsoid.

With a view to providing good thermal insulation between the rotor housing and the contact arm and to preventing arcing between the contact arm and the rotor housing, it is considered advantageous for the intermediate part to be composed of a non-conductive material.

The predefined locking position can be arranged such that the switch is closed when the intermediate part is held in the predefined locking position in a resiliently clamped manner. Alternatively, the predefined locking position can be arranged such that the switch is open when the intermediate part is held in the predefined locking position in a resiliently clamped manner. Multiple different locking positions can also be provided, for example one for the open switch state and one for the closed switch state.

With a view to achieving a favorable distribution of force, it is considered advantageous for at least two intermediate parts to be provided. The arrangement of the intermediate parts between the rotor housing and the contact arm is preferably rotationally symmetrical.

In the event of a pivoting of the contact arm relative to the rotor housing, the intermediate part is preferably pressed out of the locking position. The locking position is preferably formed by a recess (e.g. in the form of a hole, a blind hole or an indentation) in a wall section. During a further relative rotation between the contact arm and the rotor housing—i.e. after leaving the locking position and/or the recess—the intermediate part rolls and/or slides preferably on this wall section.

On the wall section, indentations are preferably provided which brake the rolling and/or sliding of the intermediate part on the wall section. Such indentations make it possible to control the pivoting movement, in particular the pivoting speed in the event of an overcurrent, in a targeted manner by choosing the geometry and the density of the indentations appropriately.

A spring is preferably arranged between the rotor housing and the pivotable contact arm. In order to achieve the locking position, a first spring end of the spring presses the intermediate part preferably into the recess in the wall section. The second spring end of the spring is preferably braced against the contact arm.

According to at least one embodiment, the first spring end presses directly onto the intermediate part, and the second spring end of the spring is braced directly against the contact arm.

The wall section is preferably formed by a wall section of the rotor housing. It is considered particularly advantageous in this regard if the rotor housing has a housing shell with an edge section whose inner edge surface forms the wall section on which the intermediate part can roll or slide and in which the recess for the locking position is positioned.

It is additionally considered advantageous if the rotor housing has a lid which laterally closes the rotor housing with the contact arm located therein. The lid lies preferably directly on the intermediate part. With a view to achieving low friction, it is considered advantageous if the intermediate part—in the event of a relative movement between the pivotable contact arm and the rotor housing—can also roll and/or slide on the lid, in particular can slide with low friction.

The lid may, for example, form an inner lid, which is rotated together with the contact arm.

In at least one embodiment, the intermediate part has, in addition to the aforementioned locking position, hereinafter called the first locking position, a second locking position, to which the intermediate part can move, after being pressed out of the first locking position and after further pivoting of the contact arm relative to the rotor housing.

The spring which presses the intermediate part into its first locking position in the recess is preferably arranged such that it can also hold the intermediate part in its second locking position in a resilient manner, for example by pressing it into a second recess or against a stop, the contact arm thereby being held in its pivoted position relative to the rotor housing.

In addition, the spring can interact with an impact body, which, in the event of a pivoting of the contact arm relative to the rotor housing and a resulting deformation of the spring, is brought into contact with the intermediate part and presses the intermediate part out of the first and/or the second locking position. An impact body may, for example, reduce the effect of friction on the rotational movement of the contact arm.

The contact arm of the switch is preferably pivoted if the current flowing via the contact arm exceeds a predefined value or the rotor housing is rotated.

BRIEF DESCRIPTION OF THE DRAWINGS

The invention will be explained in detail below with the aid of example embodiments; by way of example.

In the figures, for the sake of clarity, the same reference characters are used consistently for identical or comparable components.

DETAILED DESCRIPTION OF THE EXAMPLE EMBODIMENTS

Figure 1:
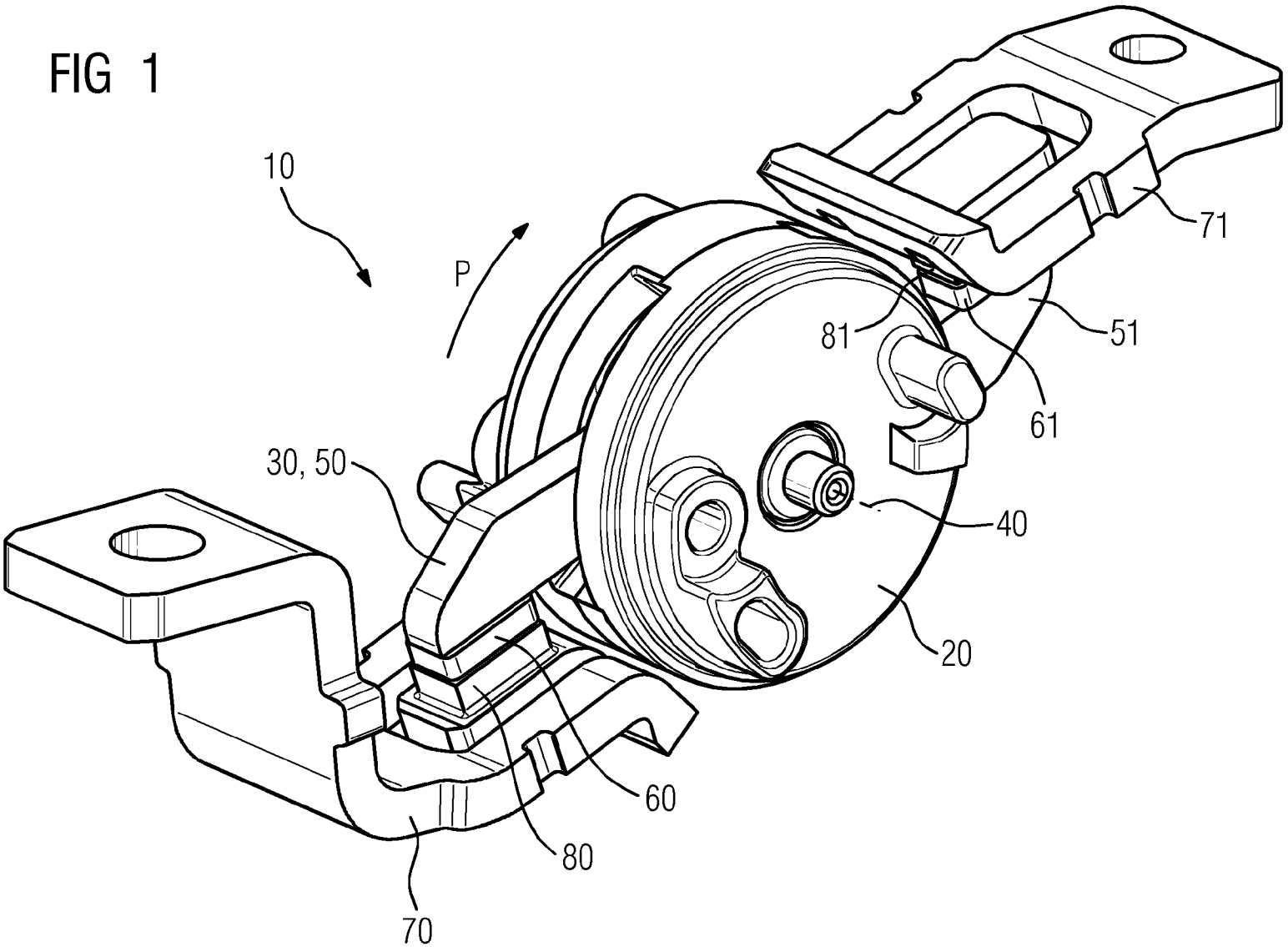
FIG. 1 shows in a three-dimensional view a first example embodiment of a switch according to the invention in the switched-on state.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

FIG. 1 shows an electric switch 10 in a three-dimensional view. A rotor housing 20, which is rotatable in the direction of the arrow P, can be seen. Located inside the rotor housing 20 is a contact bridge 30, which is pivotable together with the rotor housing 20 or else relative to the rotor housing 20, likewise in the direction of the arrow P. The axis of rotation about which the contact bridge 30 and the rotor housing 20 are rotatable and/or pivotable, is labeled with the reference character 40 in FIG. 1.

The contact bridge 30 is formed by a first contact arm 50 and a second contact arm 51. Each of the two contact arms 50 and 51 is furnished at the end of the contact arm with a contact element. The contact elements are labeled in FIG. 1 with the reference characters 60 and 61.

FIG. 1 additionally shows two stationary contact bars 70 and 71, which interact with the contact bridge 30. For this purpose, the two contact bars 70 and 71 are each furnished with a stationary contact element 80 and 81 respectively.

In the representation shown in FIG. 1, the switch 10 is closed so that an electric current can flow from the contact bar 70 via the contact bridge 30 to the contact bar 71. In order to enable this current flow, the contact elements 60 and 61 of the contact bridge 30 lie on the corresponding stationary contact elements 80 and 81 of the two contact bars 70 and 71.

Figure 2:
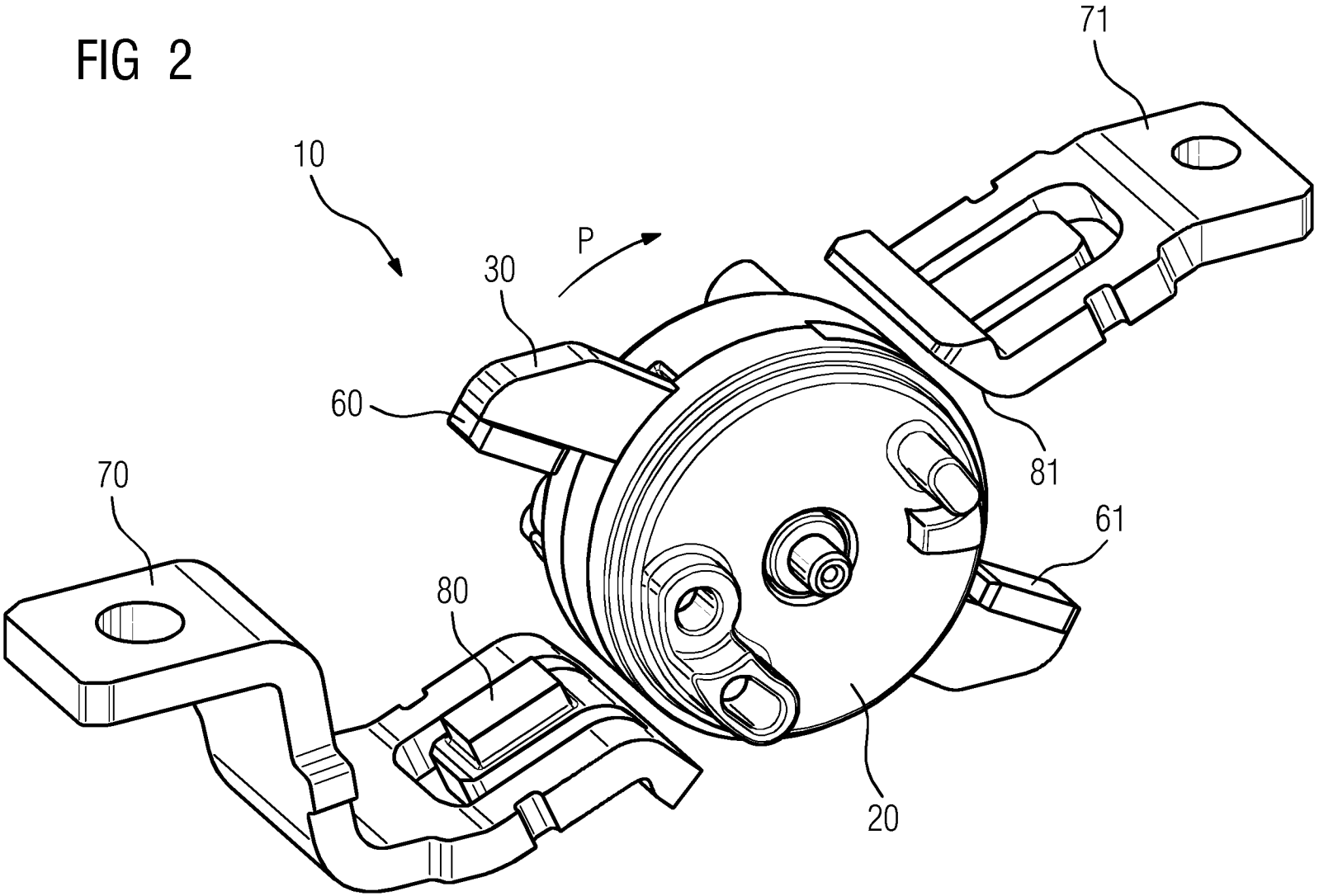
FIG. 2 shows in a three-dimensional view the switch according to FIG. 1 in the switched-off state.

FIG. 2 shows the switch 10 according to FIG. 1 in the switched-off state. It can be seen that the contact bridge 30 is pivoted relative to the rotor housing 20 and relative to the position shown in FIG. 1. Due to the angle of pivot, the contact elements 60 and 61 of the contact bridge 30 are separated from the corresponding stationary contact elements 80 and 81 of the two contact bars 70 and 71.

Figure 3:
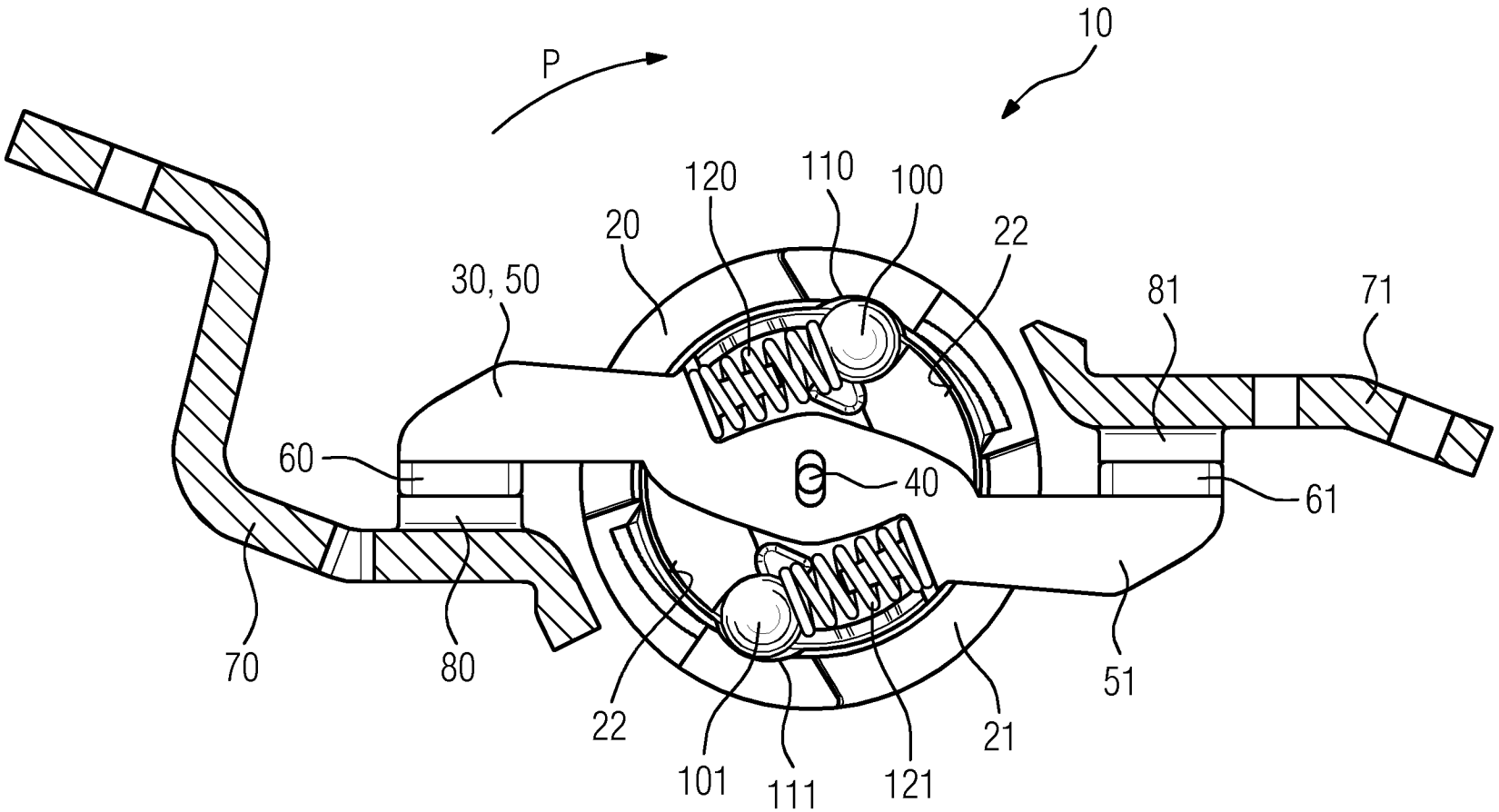
FIG. 3 shows in cross section the switch according to FIGS. 1 and 2 in the switched-on state.

FIG. 3 shows in cross section the switch 10 according to FIG. 1 in the switched-on state. The two contact bars 70 and 71 can be seen with their appurtenant stationary contact elements 80 and 81, on which the contact elements 60 and 61 of the contact bridge 30 lie.

It can also be seen that the rotor housing 20 has a housing shell 21 with an edge section, the inner edge surface of which is labeled with the reference character 22. The inner edge surface 22 forms a wall section, on which two intermediate parts in the shape of spheres 100 and 101 can slide and/or roll.

In the switched-on state of the switch 10 shown in FIG. 3, the two spheres 100 and 101 are located in first recesses 110 and 111, in which they are held resiliently by springs 120 and 121. The first two recesses 110 and 111 thus define a first locking position for the contact bridge 30 and the two spheres 100 and 101.

The two spheres 100 and 101 form separate parts which are not mechanically connected either to the housing shell 21 or the rotor housing 20 or to the contact bridge 30. The spheres 100 and 101 are separate independent parts which are merely held between the housing shell 21 of the rotor housing 20 and the contact bridge 30 in a resiliently clamped manner by the two spheres 120 and 121.

To assemble the switch 10, the two spheres 100 and 101 have therefore merely to be inserted into the recesses 110 and 111 and clamped firmly there by way of the two springs 120 and 121.

As can additionally be seen from FIG. 3, the two springs 120 and 121 each have two spring ends, of which a first spring end presses directly onto one of the two spheres and of which the second spring end is braced against one of the contact arms of the contact bridge 30. In order to guarantee an even transmission of force, the one of the two springs 120 is braced against the contact arm 50 of the contact bridge 30 and the other spring 121 against the second contact arm 51 of the contact bridge 30.

In order to define the first locking position of the contact bridge 30 shown in FIG. 3, only the rotor housing 20, the contact bridge 30, the two spheres 100 and 101 and the two springs 120 and 121 are therefore needed. No further parts are required.

If the current that flows via the contact bridge 30 from the one contact bar 70 to the other contact bar 71 and vice versa becomes too great, magnetic forces act indirectly or directly on the contact bridge 30, as a result of which the contact bridge 30 will be pivoted in the direction of pivot P. This pivoting movement occurs relative to the rotor housing 20. In the event of such a pivoting movement occurring, the two springs 120 and 121, which are braced against the contact bridge 30, exert a compressive force onto the two spheres 100 and 101 and press these out of their recess 110 and 111 respectively. After being pressed out in this way, the two spheres 100 and 101 roll on the inner edge surface 22 of the housing shell 21 in the direction of the arrow P.

Figure 4:
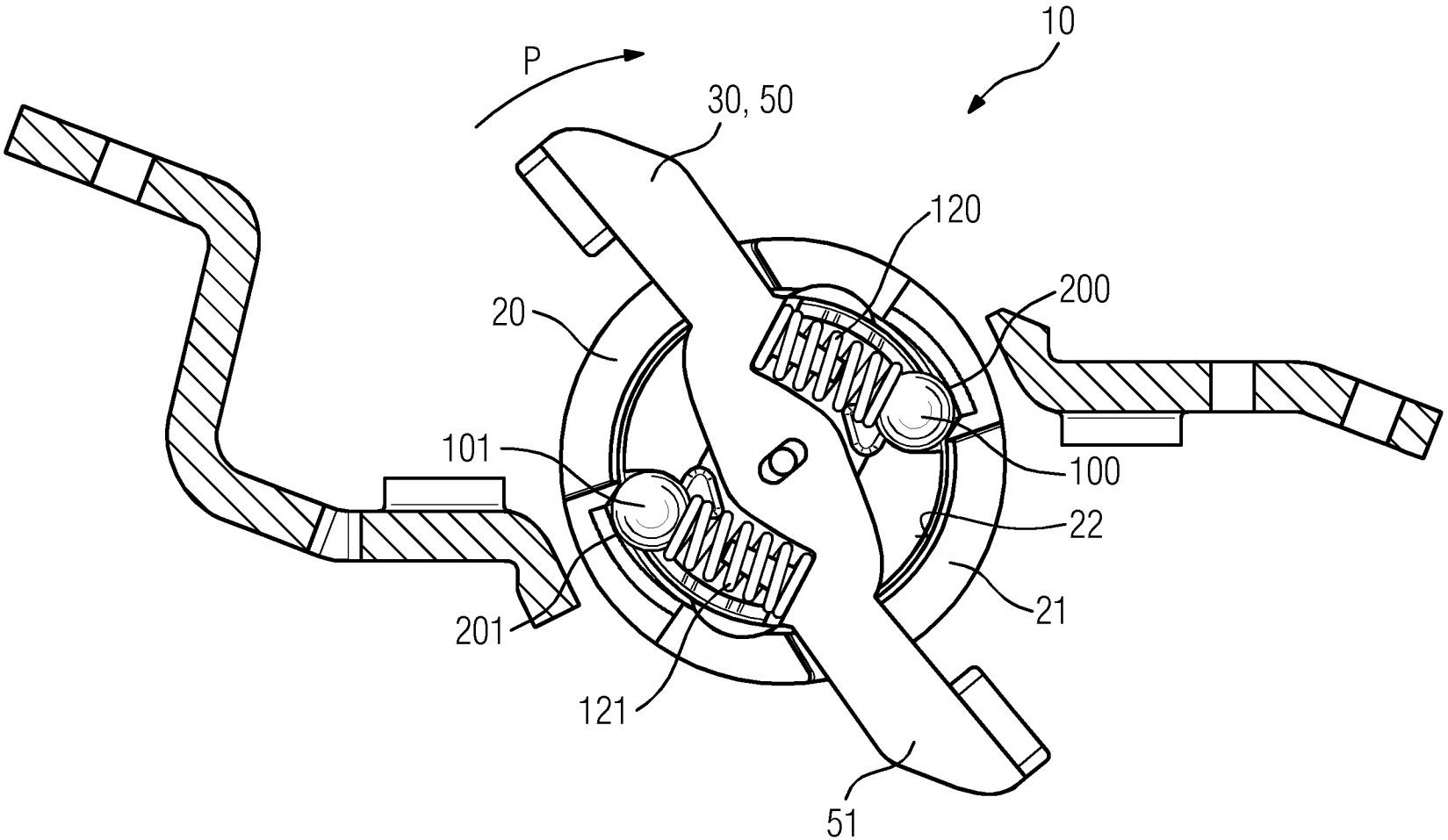
FIG. 4 shows in cross section the switch according to FIGS. 1 to 3 in the switched-off state.

FIG. 4 shows the state of the switch 10 after the contact bridge 30 has been pivoted relative to the rotor housing 20. Due to the pivoting of the contact bridge 30, the spheres 100 and 110 have been rolled on the inner edge surface 22 of the housing shell 21 and have each been brought to a second locking position of the contact bridge 30; this second locking position is defined by second recesses 200 and 201. In the second locking position, the two spheres 100 and 101 are also held resiliently, and they continue to be so by the two springs 120 and 121, which are braced against the two contact arms 50 and 51 of the contact bridge 30.

The second locking position ensures that the open switch state of the contact elements which is shown in FIG. 4 can also lock, and the switch remains open even when the trip current which has caused the rotation of the contact bridge 30, falls again.

Figure 5:
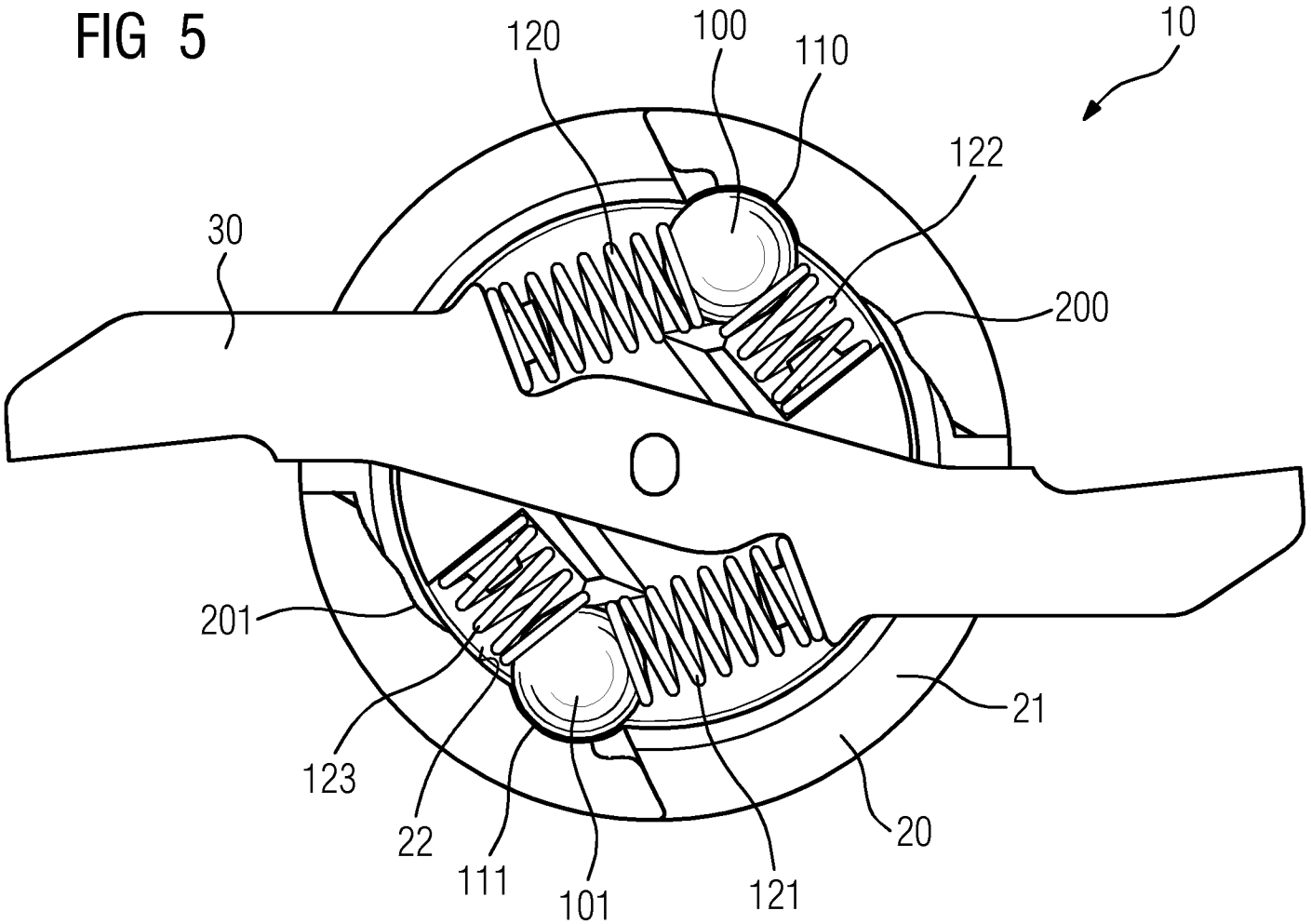
FIG. 5 shows in cross section a second example embodiment of a switch according to the invention in the switched-on state.

FIG. 5 shows a second example embodiment of a switch 10. The contact bridge 30, which is rotatably mounted inside the housing shell 21 of a rotor housing 20, can be seen. Also visible are two spheres 100 and 101, which are located in recesses 110 and 111 and are each resiliently held there by two springs 120, 121, 122, 123. The example embodiment according to FIG. 5 thus differs from the example embodiment according to FIGS. 1 and 4 in that, for each sphere 100 and 101, two springs are used in place of just a single spring.

If the current flowing through the contact bridge 30 exceeds a threshold value, then—as explained previously—this will cause a pivoting of the contact bridge 30 relative to the rotor housing 20, as a result of which the two spheres 100 and 101 will each be pressed out of their recess 110 and 111, respectively. The two spheres 100 and 101 will roll on the inner edge surface 22 of the housing shell 21 and enter second recesses 200 and 201. In these second recesses 200 and 201, the two spheres 100 and 101 will each also be resiliently held by the four springs.

In other respects, the example embodiment according to FIG. 5 corresponds to the example embodiment according to FIGS. 1 to 4.

Figure 6:
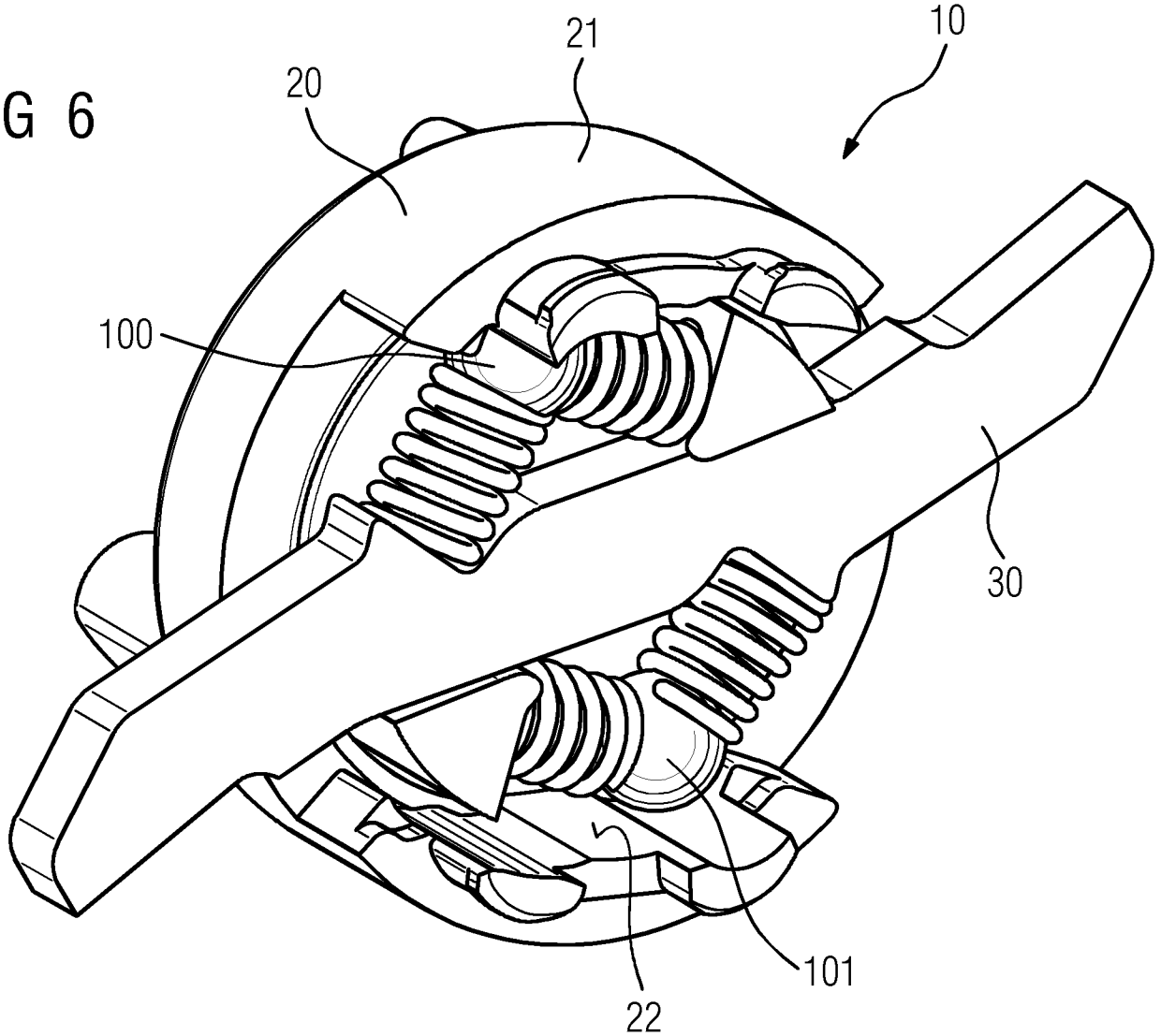
FIG. 6 shows the switch according to FIG. 5 in a three-dimensional view.

FIG. 6 shows the switch 10 according to FIG. 5 once again in a three-dimensional view. The housing shell 21 of the rotor housing 20 can be seen, in which housing shell the contact bridge 30 is resiliently held in a pivotable manner. Also visible are the spheres 100 and 101, which are each resiliently held by two springs, the spheres being pressed onto the inner edge surface 22 of the housing shell 21.

Figure 7:
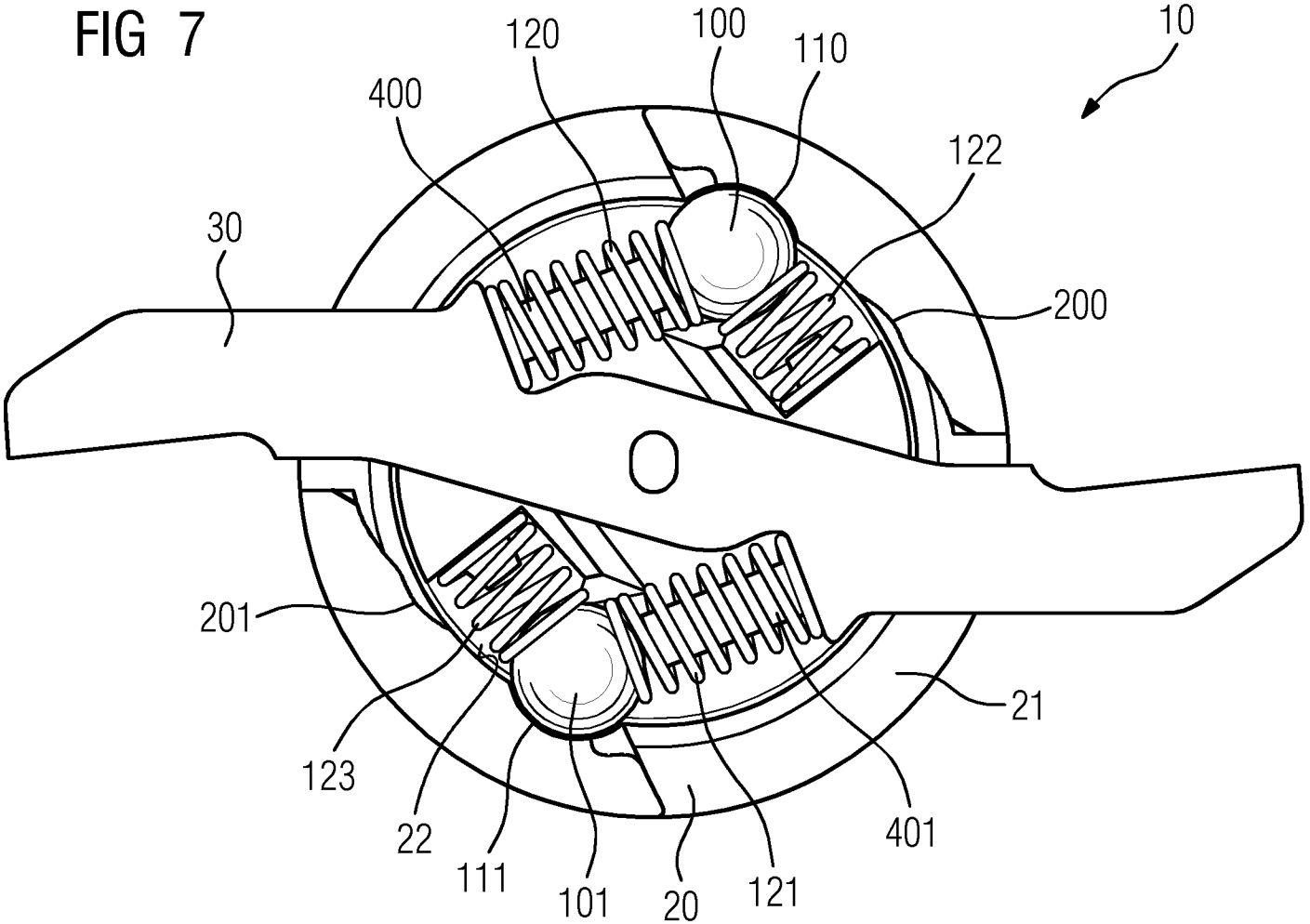
FIG. 7 shows in cross section a third example embodiment of a switch according to the invention in the switched-on state and FIG. 8 shows a fourth example embodiment of a switch according to the invention with an inner lid.

FIG. 7 shows a third example embodiment of a switch 10, in which impact bodies 400 and 401 are additionally provided. The function of the impact bodies 400 and 401 is to force the expulsion of the spheres 100 and 101 from the recesses 110 and 111, irrespective of frictional forces which may be holding the spheres in their recesses. The impact bodies thus define very precisely the latest time by which the two spheres 100 and 101 will have left their respective recess 110 and 111.

In other respects, the third example embodiment corresponds to the second example embodiment according to FIGS. 5 and 6.

Impact bodies like those shown in FIG. 7 can also be used in the example embodiment according to FIGS. 1 to 4, in which just one spring is provided for each sphere.

Figure 8:
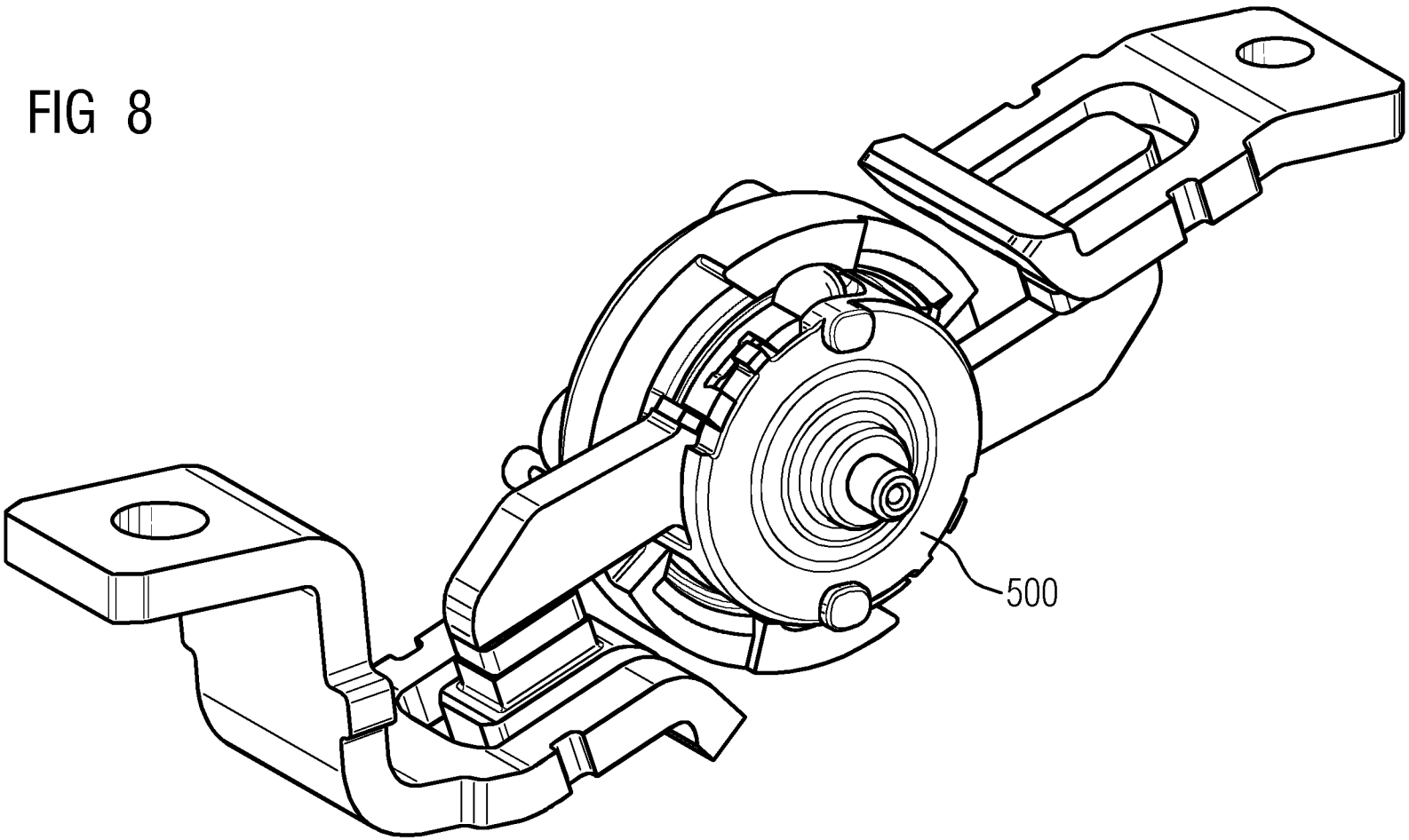

Alternatively or additionally, impact bodies may also be provided on an inner lid 500 (cf. FIG. 8) with which the housing shell of the rotor housing is sealed on the inside. For example, the impact bodies may be provided on the inner contour of the inner lid. The inner lid 500 is in such a case preferably assembled such that it can rotate together with the contact bridge relative to the housing shell.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE CHARACTERS

10 switch
20 rotor housing
21 housing shell
22 inner edge surface
30 contact bridge
40 axis of rotation
50 contact arm
51 contact arm
60 contact element
61 contact element
70 contact bar
71 contact bar
80 contact element
81 contact element
100 sphere
101 sphere
110 first recess
111 first recess
120 spring
121 spring
122 spring
123 spring
200 second recess
201 second recess
400 impact body
401 impact body
500 inner lid
P direction of arrow, pivoting direction

What is claimed is:

1. An electric switch, comprising:

a rotor housing including a wall section, the wall section including at least two recesses formed at a desired depth in the wall section;

at least one electric contact arm, rotatably mounted in the rotor housing, said at least one electric contact arm being pivotable between an on-position and an off-position, and relative to the rotor housing; and at least one intermediate part including, at least one locking element which, in a first locking position, is adapted to lock the pivotable at least one electric contact arm with the rotor housing using a first recess of the at least two recesses and which, in the event of a relative rotation between the pivotable electric contact arm and the rotor housing, is adapted to be moved away from the first locking position to a second locking position using a second recess of the at least two recesses, the at least one locking element being held in the first and second locking positions in a resiliently clamped manner, and at least one spring, arranged between the rotor housing and the pivotable electric contact arm, a first end of the at least one spring pressing onto the at least one locking element and a second end of the at least one spring being braced against the pivotable electric contact arm.

2. The electric switch as claimed in claim 1, wherein the at least one locking element is one of a sphere and an ellipsoid.

3. The electric switch as claimed in claim 1, wherein the at least one locking element is composed of a non-conductive material.

4. The electric switch as claimed in claim 1, wherein in the event of a pivoting of the electric contact arm relative to the rotor housing, the at least one locking element is adapted to be pressed out of the first recess in the wall section, and after leaving the first recess, the at least one locking element is adapted to at least one of roll and slide on the wall section during a further relative rotation between the contact arm and the rotor housing.

5. The switch as claimed in claim 4, wherein indentations are present on the wall section to brake the at least one of rolling and sliding of the at least one locking element on the wall section.

6. The electric switch as claimed in claim 1, wherein the rotor housing includes a housing shell with an edge section, an inner edge surface of the edge section forming the wall section on which the at least one locking element rolls or slides and in which the at least two recesses are positioned.

7. The electric switch as claimed in claim 1, wherein the at least one locking element is adapted to enter the second locking position after being pressed out of the first locking position and after further pivoting of the pivotable electric contact arm relative to the rotor housing.

8. The electric switch as claimed in claim 7, wherein the at least one spring is adapted to press the at least one locking element into the first recess in the first locking position and is adapted to press the at least one locking element into the second recess in the second locking position such that the pivotable electric contact arm is held in a pivoted position relative to the rotor housing.

9. An electric switch, comprising:

a rotor housing;

at least one electric contact arm, rotatable mounted in the rotor housing, said at least one electric contact arm being pivotable between an on-position and an off-position, and relative to the rotor housing; and at least one intermediate part including at least one locking element which, in a locking position, is adapted to lock the pivotable at least one electric contact arm with the rotor housing and which, in the event of a relative rotation between the pivotable electric contact arm and the rotor housing, is adapted to be moved away from the locking position, the at least one locking element being held in the locking position in a resiliently clamped manner, wherein an impact body is adapted to interact with a spring connected to the at least one locking element, said impact body, upon pivoting of the electric contact arm relative to the rotor housing and deformation of the spring, being brought into contact with the at least one locking element and pressing the at least one locking element out of the recess.

10. The electric switch as claimed in claim 1, wherein the electric switch is an electric circuit-breaker.

11. The electric switch as claimed in claim 3, wherein the at least one locking element is one of a sphere and an ellipsoid.

* * * * *